US009410347B2

(12) United States Patent
Seo et al.

(10) Patent No.: US 9,410,347 B2
(45) Date of Patent: Aug. 9, 2016

(54) SHORT DROP MECHANISM FOR VEHICLE DOOR

(71) Applicant: Hyundai Motor Company, Seoul (KR)

(72) Inventors: Yong Dae Seo, Hwaseong-si (KR); Kyoung Ho Cho, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 114 days.

(21) Appl. No.: 14/313,959

(22) Filed: Jun. 24, 2014

(65) Prior Publication Data

US 2015/0008103 A1 Jan. 8, 2015

(30) Foreign Application Priority Data

Jul. 3, 2013 (KR) ..... 10-2013-0077953

(51) Int. Cl.

| | |
|---|---|
| ***H01H 21/02*** | (2006.01) |
| ***E05B 85/16*** | (2014.01) |
| ***E05B 81/76*** | (2014.01) |
| *H01H 3/16* | (2006.01) |

(52) U.S. Cl.

CPC ..... *E05B 85/16* (2013.01); *E05B 81/76* (2013.01); *H01H 3/163* (2013.01)

(58) Field of Classification Search

CPC ..... H01H 21/02; E05F 15/70
USPC ..... 200/61.62, 302.1–302.2; 49/31, 280, 49/506

See application file for complete search history.

(56) References Cited

U.S. PATENT DOCUMENTS

| | | | | |
|---|---|---|---|---|
| 2002/0046439 | A1* | 4/2002 | Agostini | E05B 81/76 16/110.1 |
| 2002/0108310 | A1 | 8/2002 | Schroer | |
| 2011/0314737 | A1 | 12/2011 | Schindhelm et al. | |

FOREIGN PATENT DOCUMENTS

| | | | |
|---|---|---|---|
| KR | 1997-0044018 | A | 7/1997 |
| KR | 10-2007-0062329 | A | 6/2007 |
| WO | WO 2011/023955 | A1 | 3/2011 |

* cited by examiner

*Primary Examiner* — Edwin A. Leon
*Assistant Examiner* — Iman Malakooti
(74) *Attorney, Agent, or Firm* — Morgan, Lewis & Bockius LLP

(57) ABSTRACT

A short drop apparatus for a vehicle door may include a door handle rotatably mounted to a door panel at a front side thereof and having an inner engaging part at a rear side thereof, a door lever including a guide to be engaged with the engaging part of the door handle to operate in response to a rotation of the door handle, a switch positioned in front of the door lever to selectively transmit a signal to open or close a window glass with a turning ON or OFF state of the switch, and a switch lever engaged to the switch and coming into contact with a front side of the door lever at front and rear sides of the switch lever, respectively, the switch lever operating simultaneously with the door lever when the door handle may be manipulated, to turn on the switch.

6 Claims, 3 Drawing Sheets

SHORT DROP MECHANISM FOR VEHICLE DOOR

CROSS REFERENCE TO RELATED APPLICATION

The present application claims priority to Korean Patent Application No. 10-2013-0077953, filed Jul. 3, 2013, the entire contents of which is incorporated herein for all purposes by this reference.

BACKGROUND OF THE INVENTION

1. Field of the Invention

The present invention relates, in general, to a short drop mechanism for a vehicle door, which allows a window glass of the vehicle door to slide up and down when the door is opened and closed and, more particularly, to a short drop mechanism for a vehicle door, which improves a vertical actuation timing of the window glass so as to improve a manipulating feature by a driver when manipulating the door to be opened and closed.

2. Description of Related Art

Generally, a vehicle door is provided with a window glass for securing a lateral view of a vehicle, and a weather strip made of rubber for soundproofing and waterproofing features.

A door has a conventionally used door structure in which a weather strip is fixed to a door frame so that a window glass is lodged into the weather strip when moving up and down. That is, in the door, the window glass and the weather strip are all installed on the door frame, so that, when the door is opened, the window glass and the weather strip are not separated from each other, but the weather strip surrounds the moved-up window glass, advantageously having waterproofing and soundproofing features.

Recently, according to door design such as two-door design, a frameless-type door structure is available for use. Such a frameless-type door structure should be such that a weather strip is fixed to a vehicle body and a window glass is fixed to a door, so that, when the door is opened, the window glass and the weather strip are separated from each other. Thus, the weather strip has a shape in which one side thereof is opened in order to prevent interference with the opening of the door, thereby having poor soundproofing and waterproofing features.

To solve these problems of poor soundproofing and waterproofing features, the weather strip is adapted such that, when a door is closed, the window glass is surrounded by the weather strip. However, in this case, when the door is opened, interference of the window glass with the weather strip occurs, degrading manipulating performance of the door when opening and closing.

In the meantime, in order to solve the problems with the frameless-type door structure, the short drop of a window glass has been recently adapted. The short drop performs a function that, when detecting a door-opening action, quickly lowers the window glass by a certain distance under the control of a drive motor for a vertical motion of the window glass, and when detecting a door-closing action, raises the window glass by the previously lowered distance.

Such a short drop function makes it possible to prevent the interference of the window glass with the weather strip when the door is opened and closed, to allow the weather strip to surround the window glass, improving the soundproofing and waterproofing problems, and to open and close the window glass by a predetermined amount so as to control the internal pressure inside of a vehicle, improving the opening and closing performance of a door.

However, a conventional short drop system is such that a short drop switch 2 is mounted to a vehicle body 3 so that, when a door 1 is opened and closed, the system detects ON/OFF of the switch so as to implement a short drop function. Specifically, in a door-closed state, the door comes into contact with the switch mounted to the vehicle body, allowing the switch to maintain an ON state, and in a door-opened state, the door moves out of the contact state with respect to the switch, rendering the switch to enter an OFF state, allowing the window glass to move down.

A conventional short drop system operates in the following sequential procedure: manipulation of a handle—unlocking of a latch—partial opening of a door—switch OFF—determination of a controller—actuation of a window motor—a downward motion of a window glass.

However, such a conventional short drop system has problems in that, when the door is opened before the activation of the short drop function, an interference of the window glass with the weather strip occurs, so that the weather strip is subjected to abrasion, or the manipulation performance of the door is degraded due to a repulsive force by the weather strip. Further, in the conventional system, since the short drop function is activated when the door is just opened, the manipulation performance of the door is further degraded.

Similar problems occur with the conventional short drop system because a short drop signal is received when the door is already opened.

Thus, there is a need to improve a short drop function such as the performance of manipulation, e.g. manipulation feeling, quality or the like, by completely separating a door opening period and a short drop activating time.

The information disclosed in this Background of the Invention section is only for enhancement of understanding of the general background of the invention and should not be taken as an acknowledgement or any form of suggestion that this information finals the prior art already known to a person skilled in the art.

BRIEF SUMMARY

Various aspects of the present invention are directed to providing a short drop mechanism for a vehicle door, in which a door opening period and a short drop activating timing are completely separated so that a short drop function is first activated before the door is opened, thereby improving the manipulation feeling and manipulation quality when opening and closing the door.

In an aspect of the present invention, a short drop apparatus for a vehicle door may include a door handle rotatably mounted to a door panel at a front side thereof and having an inner engaging part at a rear side thereof, a door lever including a guide to be engaged with the engaging part of the door handle to operate in response to a rotation of the door handle, a switch positioned in front of the door lever to selectively transmit a signal to open or close a window glass with a turning ON or OFF state of the switch, and a switch lever engaged to the switch and coming into contact with a front side of the door lever at front and rear sides of the switch lever, respectively, the switch lever operating simultaneously with the door lever when the door handle is manipulated, to turn on the switch.

The door lever is mounted to the door panel in the door handle by a hinge pin and an elastic member is mounted to the hinge pin and the door handle, the door lever being selectively rotated inwards or outwards in response to a manipulation of the door handle to elastically return to an initial position thereof.

The switch lever is positioned on the door panel in front of the door lever, the front and rear sides of the switch lever being rotatable in inward and outward directions, wherein the switch lever may include an elastic middle part.

The elastic middle part of the switch lever is a torsion spring mounted to a hinge pin and the switch lever to elastically bias the rear side of the switch lever to be rotated in the inward direction, wherein the switch lever is rotatably mounted to the hinge pin.

The rear side of the switch lever is engaged with the front side of the door lever and restricted from rotating when the door handle is not manipulated and is in an initial state.

The front side of the door lever may include a support part to which the rear side of the switch lever is engaged and supported, and the support part may have a predefined curvature.

The rear side of the switch lever is disengaged from the front side of the door lever and is elastically rotated inwards, upon rotation of the door lever by the manipulation of the door handle, and the front side of the switch lever is rotated outwards by the elastic middle part, allowing the switch to switch to the ON state.

The switch may include a button part on a side of the switch lever, and the button part is integrally connected to the front side of the switch lever.

According to the short drop mechanism of the present invention, upon the manipulation of the door handle, the switch is first activated before the door is opened, so as to allow a vertical motion of the window glass. With the configuration in which the door is opened after the short drop function is already activated, the manipulation feeling and the manipulation quality are enhanced when opening and closing the door.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
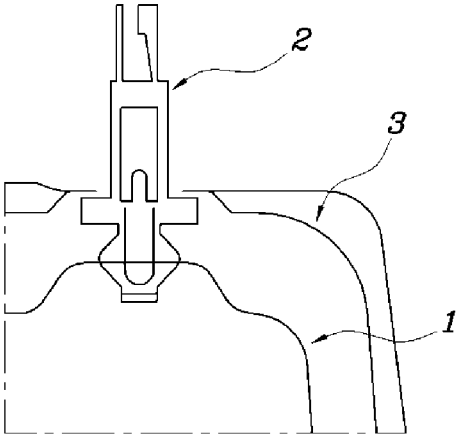
FIG. 1 (Related Art)
FIG. 1 is a view illustrating the mounting position of a switch in a conventional short drop system.

Reference numerals set forth in the Drawings include reference to the following elements as further discussed below.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, an exemplary embodiment of the present invention will be described with reference to the accompanying drawings so that those skilled in the Field of the Invention to which the present invention pertains may carry out the exemplary embodiment.

FIG. 1 is a view illustrating the mounting position of a switch in a conventional short drop system. In the present invention, a window glass can be raised and lowered using a door opening device which is adapted to a conventional vehicle. Such a door opening device includes a drive motor for providing a driving force to vertically move the window glass, and a body control module (BCM) for controlling the vertical motion of the window glass. The door opening device is a device known in the art, so a detailed description thereof will be omitted.

Figure 2:
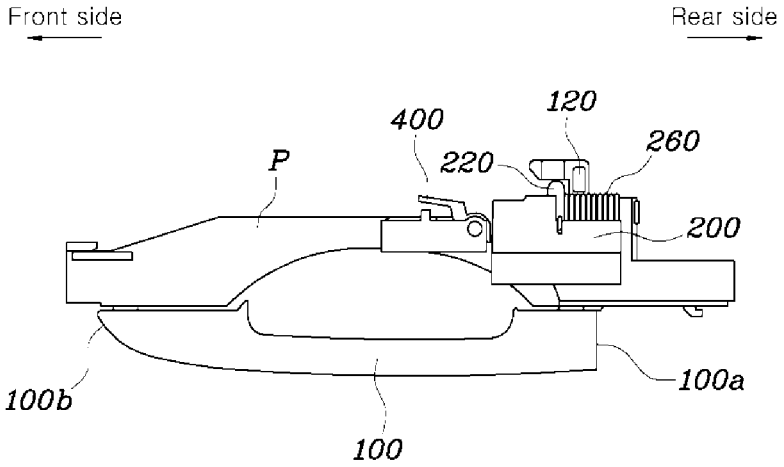
FIG. 2 is a view illustrating the external side of a short drop mechanism for a vehicle door according to an exemplary embodiment of the present invention.
Figure 3:
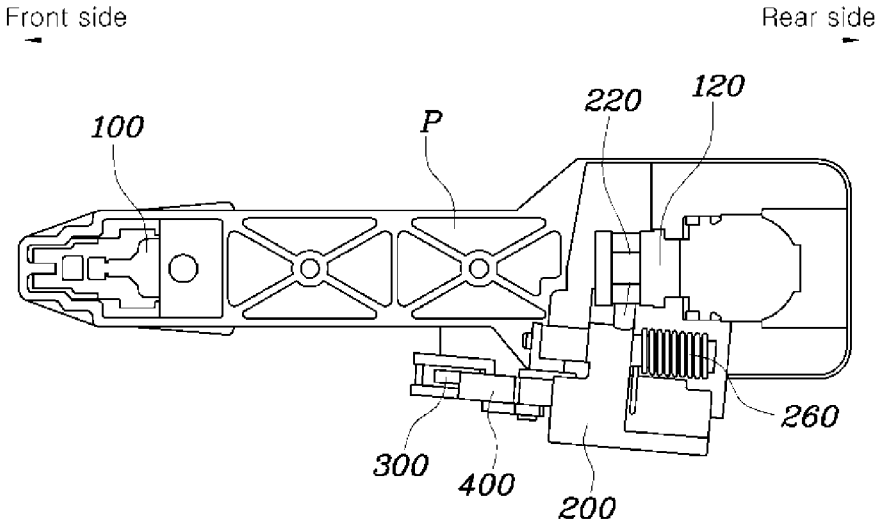
FIG. 3 is a view illustrating the internal side of the short drop mechanism shown in FIG. 2 according to an exemplary embodiment of the present invention.
Figure 4:
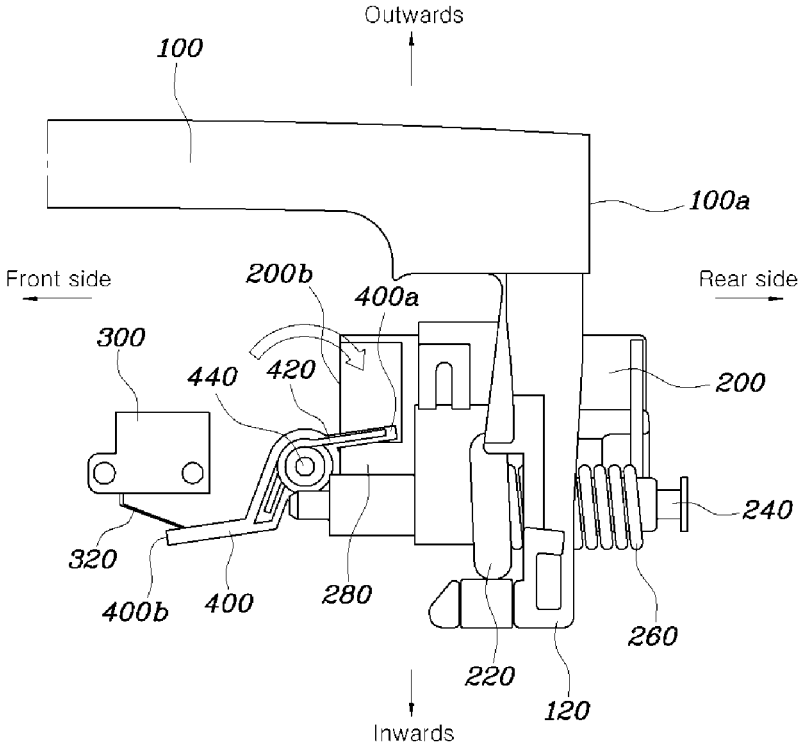
FIGS. 4 and 5 are views illustrating the operation of the short drop mechanism according to an exemplary embodiment of the present invention.
Figure 5:
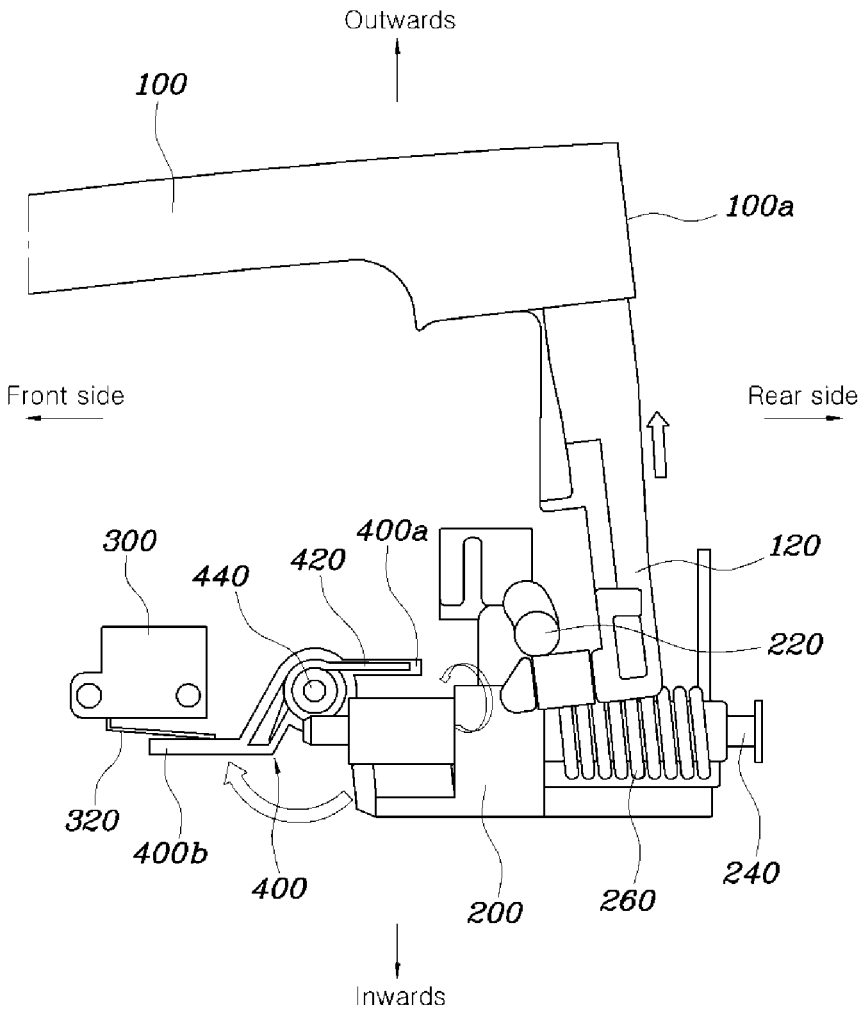

FIG. 2 is a view illustrating the external side of a short drop mechanism for a vehicle door according to an embodiment of the present invention. FIG. 3 is a view illustrating the internal side of the short drop mechanism shown in FIG. 2. FIGS. 4 and 5 are views illustrating the operation of the short drop mechanism of the present invention.

Referring to FIGS. 2 to 5, the short drop mechanism may include a door handle 100 which is rotatably mounted to a door panel P at a front side 100*b* thereof and has an inner engaging part 120 at a rear side 100*a* thereof, a door lever 200 which has a guide 220 to be engaged with the engaging part 120 of the door handle 100 so as to operate in response to a rotation of the door handle 100, a switch 300 which is positioned in front of the door lever 200 so as to selectively transmit a signal to open or close a window glass with the turning ON or OFF state of the switch and a switch lever 400 which is connected to the switch 300 and comes into contact with a front side 200*b* of the door lever 200 at front and rear sides 400*b* and 400*a* of the switch lever, respectively, so as to operate together with the door lever 200 when the door handle 100 is manipulated, to turn on the switch 300.

In an aspect of the present invention, in order to solve the problem faced by related art that when the short drop function is activated, the window glass is moved down only after the door is opened, thereby causing interference between the weather strip and operation of the window glass, the short drop mechanism for a vehicle door is configured such that when the door handle 100 is manipulated, the door lever 200 is rotated simultaneously with the switch lever 400, thereby turning on the switch 300.

Therefore, in contrast to the related art in which the switch is mounted to a vehicle body so that the short drop function is carried out after the door is opened, an exemplary embodiment of the present invention is configured such that the switch 300 is mounted to the door panel P so that the short drop function is activated just after the door handle 100 is manipulated, so that the window glass moves down before the door is opened.

The door handle 100 may be rotatably mounted to the door panel P at the front side 100*b* of the door handle 100 and have the inner engaging part 120 at the rear side 100*a* thereof, and the door lever 200 has the guide 220 to be engaged with the engaging part 120 of the door handle 100 so as to operate in response to the rotation of the door handle 100. The door lever 200 is mounted to the door panel P inside of the door handle 100 by a hinge pin 240 and an elastic member 260 that is mounted to the door lever 200 and the hinge pin 240.

The door lever 200 may be coupled to a latch device of a door lock (not shown) by a wire and the elastic member 260 is composed of a return spring, so that, even when the door lever 200 is rotated by the manipulation of the door handle 100, the door lever elastically returns to its initial position when released by the elastic force of the return spring. When the door handle 100 is pulled out, the door lever 200 is also pulled out and rotated by the engaging part 120, and at the same time, the wire is pulled so that the latch device of the door lock is unlocked.

The switch 300 may be positioned in front of the door lever 200 so as to selectively transmit a signal to open or close the window glass with the turning ON or OFF state of the switch respectively. The switch 300 may be electrically connected to a body control module (BCM) to control a drive motor, and switches between an ON state and an OFF state with the rotation of the switch lever 400 as mentioned above.

The switch lever 400 for turning ON/OFF the switch 300 is connected to the switch 300 and comes into contact with a front side 200*b* of the door lever 200 at front and rear sides 400*b* and 400*a* of the switch lever 400, respectively, so that the switch lever operates together with the door lever 200 when the door handle 100 is manipulated.

The switch 300 may be provided in proximity to the mounting structure of the door handle 100 such that upon rotation of the door lever 100 due to the manipulation of the door handle 100, the switch lever 400 is simultaneously rotated so that the switch 300 is instantly turned ON/OFF, allowing a rapid activation of the short drop function when the door handle 100 is manipulated.

In general, when a door is intended to open with the manipulation of the door handle 100, the door can be opened only when the door handle is sufficiently pulled out. In an aspect of the present invention, the period during door opening when the door handle 100 is pulled out to a point just before it opens is called an 'unavailable stroke period'. In the unavailable stroke period, although the door handle is manipulated so that the door lever 200 is rotated, the amount of rotation of the door lever 200 and thus the pulling of the wire coupled to the latch device of the door lock are not sufficient, so that the door cannot be opened. The present invention allows the short drop function to be activated in the unavailable stroke period, so that the switch lever 400 is rotated so as to push the switch 300 to open the window glass, within a rotation range of the door lever 200 before the door lock (not shown) is not yet unlocked.

FIGS. 4 and 5 are views illustrating the operation of the short drop mechanism according to an exemplary embodiment of the present invention. Referring to FIGS. 4 and 5, the switch lever 400 may be positioned on the door panel P in front of the door lever 200 such that the front and rear sides 400*b* and 400*a* of the switch lever 400 are rotatable in inward and outward directions, and the switch lever 400 may include an elastic middle part 420. The elastic middle part 420 of the switch lever 400 may be a torsion spring to elastically force the rear side 400*a* of the switch lever 400 to be rotated in the inward direction.

The switch lever 400 may be rotatably mounted to the door panel P in front of the door lever 200 by hinge pin 440, such that the rear side 400*a* comes into contact with the front side 200*b* of the door lever 200 and the front side 400*b* is coupled to the switch 300. The middle section of the switch lever 400 is includes the elastic middle part 420 mounted to the hinge pin 440, which may be a torsion spring, to elastically rotate the rear side 400*a* of the switch lever 400 in the inward direction. Thus, as the rear side 400*a* of the switch lever 400 is elastically rotated in the inward direction by the elastic force, the front side 400*b* is rotated outwards to allow the switch 300 to switch to the ON state.

The switch lever 400 may function such that, when the door handle 100 is not manipulated and is in an initial state, although the switch lever 400 is subjected to an elastic force due to the elastic middle part 420, the rear side 400*a* of the switch lever 400 is engaged with the front side 200*b* of the door lever 200, being restricted from rotating.

The front side 200*b* of the door lever 200 may include with a support part 280 by which the rear side 400*a* of the switch lever 400 is engaged and supported; and the support part 280 may have a predefined curvature.

In an aspect of the present invention, the rear side 400*a* of the switch lever 400 comes into contact with the front side 200*b* of the door lever 200 such that the rear side 400*a* of the switch lever 400 is engaged with and supported by the front side 200*b* of the door lever 200. The front side 200*b* of the door lever 200 may include a support part 280. The support part 280 may include a protrusion on the front side 200*b* of the door lever 200 at a position corresponding to the rear side 400*a* of the switch lever 400 so as to allow rear side 400*a* of the switch lever 400 to rest on a portion of the protrusion. The support part 280 may have an inclined surface having a predefined curvature so that the rear side 400*a* of the switch lever 400 comes into and out of contact with the front side 200*b* of the door lever 200 while siding along the inclined surface.

For example, if the support part 280 of the door lever 200 has a simple rectangular shape, when the door handle is pulled out and released to be returned to its initial position, the door handle cannot be returned to the initial position because the front side 200*b* of the door lever 200 will be engaged with the rear side 400*a* of the switch lever 400. Thus, the support part 280 of the door lever 200 has the inclined surface with a predefined curvature at a position where the switch lever 400 comes into contact, so that, upon rotation of the door lever 200, the switch lever 400 can smoothly move in response to the action of the door lever.

The switch lever 400 may be operated such that, upon rotation of the door lever 200 by the manipulation of the door handle 100, the rear side 400*a* of the switch lever 400 is disengaged from the front side 200*b* of the door lever 200 and is elastically rotated inwards, and the front side 400*b* of the switch lever is rotated outwards, allowing the switch 300 to switch to the ON state. This allows the switch 300 to switch to the ON state before the door is opened, so that the body control module activates the drive motor in response to the electric signal from the switch 300, thereby allowing the window glass to move down. The switch 300 is turned on within the unavailable stroke period and then the short drop function is activated before the door is opened, thereby improving the manipulation feeling when opening or closing the door.

The switch 300 may include a button part 320 which may be integrally coupled to the front side 400*b* of the switch lever 400. The integral connection between the button part 320 of the switch 300 and the front side 400*b* of the switch lever 400 allows for the simultaneous operation of the button part 320 when the switch lever 400 is rotated by the manipulation of the door handle 100, so that the switch 300 is able to immediately perceive such an operation.

Upon rotation of the switch lever 400, the front side 400*b* touches the switch 300 to turn on and off the switch 300. However, in such a touch-type structure a mechanical error may occur, so an immediate perception of the switch 300 may not be obtained. Thus, it is preferred that the button part 320 of the switch 300 and the front side 400*b* of the switch lever 400 be integrally connected so that the switch 300 can immediately perceive the manipulation of the door handle 100.

The operation of the present invention will now be described with reference to FIGS. 4 and 5. When a user first manipulates the door handle 100 to be opened, the door lever 200 and the switch lever 400 are simultaneously rotated in response to the action of the door handle 100. This rotation of the door handle 100 is within the unavailable stroke period, so the opening of the door is not carried out. The rotation of the switch lever 400 enables the switch 300 to switch from the OFF state to the ON state. The body control module perceives this operation and controls the drive motor to move the window glass down.

While the window glass is lowered by a predetermined distance, the manipulation of the door handle 100 is out of the unavailable stroke period, so that the door lock (not shown) is unlocked, allowing the door to be opened.

Thus, the short drop function is first activated before the door is opened, thereby separating respective activation periods, so that, upon the opening/closing manipulation of the door, degradation of the opening/closing manipulation feeling due to the interference between the window glass and the wear strip and repulsive force of the weather strip upon the interference can be prevented.

Therefore, the present invention can provide improved manipulating feeling and quality when opening or closing the door.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A short drop apparatus for a vehicle door, comprising:

a door handle rotatably mounted to a door panel at a front side thereof and having an inner engaging part at a rear side thereof;

a door lever including a guide to be engaged with the engaging part of the door handle to relatively operate in response to a rotation of the door handle;

a switch positioned in front of the door lever to selectively transmit a signal to open or close a window glass with a turning ON or OFF state of the switch; and a switch lever engaged to the switch and coming into contact with a front side of the door lever at front and rear sides of the switch lever, respectively, the switch lever operating simultaneously with the door lever when the door handle is manipulated, to turn on the switch, wherein the rear side of the switch lever is continuously engaged with the front side of the door lever and restricted from rotating by the door lever when the door handle is not manipulated and is in an initial state, and wherein the front side of the door lever includes a support part to which the rear side of the switch lever is engaged and supported, and the support part has a predefined curvature.

2. The short drop apparatus for the vehicle door according to claim 1, wherein the door lever is mounted to the door panel in the door handle by a hinge pin and an elastic member is mounted to the hinge pin and the door handle, the door lever being selectively rotated inwards or outwards in response to a manipulation of the door handle to elastically return to an initial position thereof.

3. The short drop apparatus for the vehicle door according to claim 1, wherein the switch lever is positioned on the door panel in front of the door lever, the front and rear sides of the switch lever being rotatable in inward and outward directions, and wherein the switch lever includes an elastic middle part.

4. The short drop apparatus for the vehicle door according to claim 3, wherein the elastic middle part of the switch lever is a torsion spring mounted to a hinge pin and the switch lever to elastically bias the rear side of the switch lever to be rotated in the inward direction, wherein the switch lever is rotatably mounted to the hinge pin.

5. The short drop apparatus for the vehicle door according to claim 3, wherein the rear side of the switch lever is disengaged from the front side of the door lever and is elastically rotated inwards, upon rotation of the door lever by the manipulation of the door handle, and the front side of the switch lever is rotated outwards by the elastic middle part, allowing the switch to switch to the ON state.

6. The short drop apparatus for the vehicle door according to claim 1, wherein the switch includes a button part on a side of the switch lever, and the button part is integrally connected to the front side of the switch lever.

* * * * *